US006199228B1

(12) United States Patent
Kallweit

(10) Patent No.: US 6,199,228 B1
(45) Date of Patent: Mar. 13, 2001

(54) HEIGHT ADJUSTABLE TOILET SEAT

(76) Inventor: William F. Kallweit, 7639 Alta Cuesta, Rancho Cucamongo, CA (US) 91730

( * ) Notice: Subject to any disclaimer, the term of this patent is extended or adjusted under 35 U.S.C. 154(b) by 0 days.

(21) Appl. No.: 09/534,265

(22) Filed: Mar. 24, 2000

Related U.S. Application Data

(60) Provisional application No. 60/127,060, filed on Mar. 31, 1999.

(51) Int. Cl.[7] ..... A47K 13/10
(52) U.S. Cl. ..... 4/667; 4/204
(58) Field of Search ..... 4/254, 667

(56) References Cited

U.S. PATENT DOCUMENTS 4,888,833 * 12/1989 Garcia et al. ..... 4/667 X
5,737,780 * 4/1998 Okita et al. ..... 4/667

* cited by examiner

*Primary Examiner*—Robert M. Fetsuga
(74) *Attorney, Agent, or Firm*—Goldstein & Canino

(57) ABSTRACT

A height adjustable toilet seat including a frame member disposed on opposing sides of a toilet. The frame member has sliding plates slidably disposed thereon. The sliding plates have a toilet seat secured therebetween whereby the toilet seat is positioned over a toilet bowl of the toilet. A water supply conduit is provided that is coupled with a standard water supply line. The water supply conduit has a bifurcated outer portion for positioning with respect to the frame member. A pair of cylinders are positioned underneath the sliding plates. The pair of cylinders each have a water inlet in fluid communication with the bifurcated outer portion of the water supply conduit. The pair of cylinders each have a piston extending upwardly therefrom and securing to an underside of the sliding plates. Each of the cylinders has a water outlet. A water outlet conduit is provided that is comprised of a bifurcated portion coupling with the water outlets of the pair of cylinders. The water outlet conduit has a free end extending within the toilet bowl.

4 Claims, 1 Drawing Sheet

HEIGHT ADJUSTABLE TOILET SEAT

CROSS REFERENCES AND RELATED SUBJECT MATTER

This application relates to subject matter contained in provisional patent application Serial No. 60/127,060, filed in the United States Patent & Trademark Office on Mar. 31, 1999.

BACKGROUND OF THE INVENTION

The present invention relates to a height adjustable toilet seat and more particularly pertains to adjusting a height of a toilet seat using a standard water supply.

Older people and physically challenged people ordinarily have trouble doing everyday things, such as using the toilet. Most of these people have trouble sitting down on normally low-seated toilets. They have even more trouble getting off of these toilets and standing. These problems stem from the fact that these people have a lack of lower body strength, very little flexibility or control that is necessary to enable adequate or confident movement between erect and crouched positions.

The present invention solves the aforementioned problems by providing that which will serve to raise and lower an individual with respect to a toilet bowl. The individual will utilize hand controls to raise and lower themselves using water from a standard water supply associated with bathrooms and toilets.

The use of adjustable toilet assemblies is known in the prior art. More specifically, adjustable toilet assemblies heretofore devised and utilized for the purpose of raising and lowering a toilet seat are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,925,833 to Hunter discloses a hydraulic cylinder used in conjunction with a frame for vertically raising and lowering a toilet seat for use by an infirm person. U.S. Pat. No. 5,063,617 to Ward discloses the use of household water pressure to raise and lower a toilet seat for use by people who are disabled. U.S. Pat. No. 3,473,174 to Cool discloses means for automatically raising a user from a seated position to a standing position used in conjunction with a toilet.

While these devices fulfill their respective, particular objective and requirements, the aforementioned patents do not describe a height adjustable toilet seat for adjusting a height of a toilet seat using a standard water supply.

In this respect, the height adjustable toilet seat according to the present invention substantially departs from the conventional concepts and designs of the prior art, and in doing so provides an apparatus primarily developed for the purpose of adjusting a height of a toilet seat using a standard water supply.

Therefore, it can be appreciated that there exists a continuing need for new and improved height adjustable toilet seat which can be used for adjusting a height of a toilet seat using a standard water supply. In this regard, the present invention substantially fulfills this need.

SUMMARY OF THE INVENTION

In the view of the foregoing disadvantages inherent in the known types of adjustable toilet assemblies now present in the prior art, the present invention provides an improved height adjustable toilet seat. As such, the general purpose of the present invention, which will be described subsequently in greater detail, is to provide a new and improved height adjustable toilet seat and method which has all the advantages of the prior art and none of the disadvantages.

To attain this, the present invention essentially comprises a frame member disposed on opposing sides of a toilet. The frame member includes a pair of inverted generally U-shaped members disposed on opposing sides of the toilet. A cross bar extends between rear vertical segments of the U-shaped members. The U-shaped members each have a sliding plate slidably disposed thereon. The sliding plates have a toilet seat secured therebetween whereby the toilet seat is positioned over a toilet bowl of the toilet. A water supply conduit is provided that is coupled with a standard water supply line. The water supply conduit has a bifurcated outer portion for positioning with respect to the inverted U-shaped members. A pair of cylinders are positioned underneath the sliding plates of the inverted U-shaped members. The pair of cylinders each have a water inlet in fluid communication with the bifurcated outer portion of the water supply conduit. The pair of cylinders each have a piston extending upwardly therefrom and securing to an underside of the sliding plates. Each of the cylinders have a water outlet. A water outlet conduit is provided that is comprised of a bifurcated portion coupling with the water outlets of the pair of cylinders. The water outlet conduit has a free end extending within the toilet bowl. A pair of control valves are coupled with respect to the water supply conduit and the water outlet conduit for selectively supplying water to and removing water from the pair of cylinders to facilitate raising and lowering of the toilet seat with respect to the toilet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved height adjustable toilet seat which has all the advantages of the prior art adjustable toilet assemblies and none of the disadvantages.

It is another object of the present invention to provide a new and improved height adjustable toilet seat which may be easily and efficiently manufactured and marketed.

It is a further object of the present invention to provide a new and improved height adjustable toilet seat which is of durable and reliable construction.

An even further object of the present invention is to provide a new and improved height adjustable toilet seat which is susceptible of a low cost of manufacture with regard to both materials and labor, and which accordingly is then susceptible of low prices of sale to the consuming public, thereby making such a height adjustable toilet seat economically available to the buying public.

Even still another object of the present invention is to provide a new and improved height adjustable toilet seat for adjusting a height of a toilet seat using a standard water supply.

Lastly, it is an object of the present invention to provide a new and improved height adjustable toilet seat including a frame member disposed on opposing sides of a toilet. The frame member has sliding plates slidably disposed thereon. The sliding plates have a toilet seat secured therebetween whereby the toilet seat is positioned over a toilet bowl of the toilet. A water supply conduit is provided that is coupled with a standard water supply line. The water supply conduit has a bifurcated outer portion for positioning with respect to the frame member. A pair of cylinders are positioned underneath the sliding plates. The pair of cylinders each have a water inlet in fluid communication with the bifurcated outer portion of the water supply conduit. The pair of cylinders each have a piston extending upwardly therefrom and securing to an underside of the sliding plates. Each of the cylinders have a water outlet. A water outlet conduit is provided that is comprised of a bifurcated portion coupling with the water outlets of the pair of cylinders. The water outlet conduit has a free end extending within the toilet bowl.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
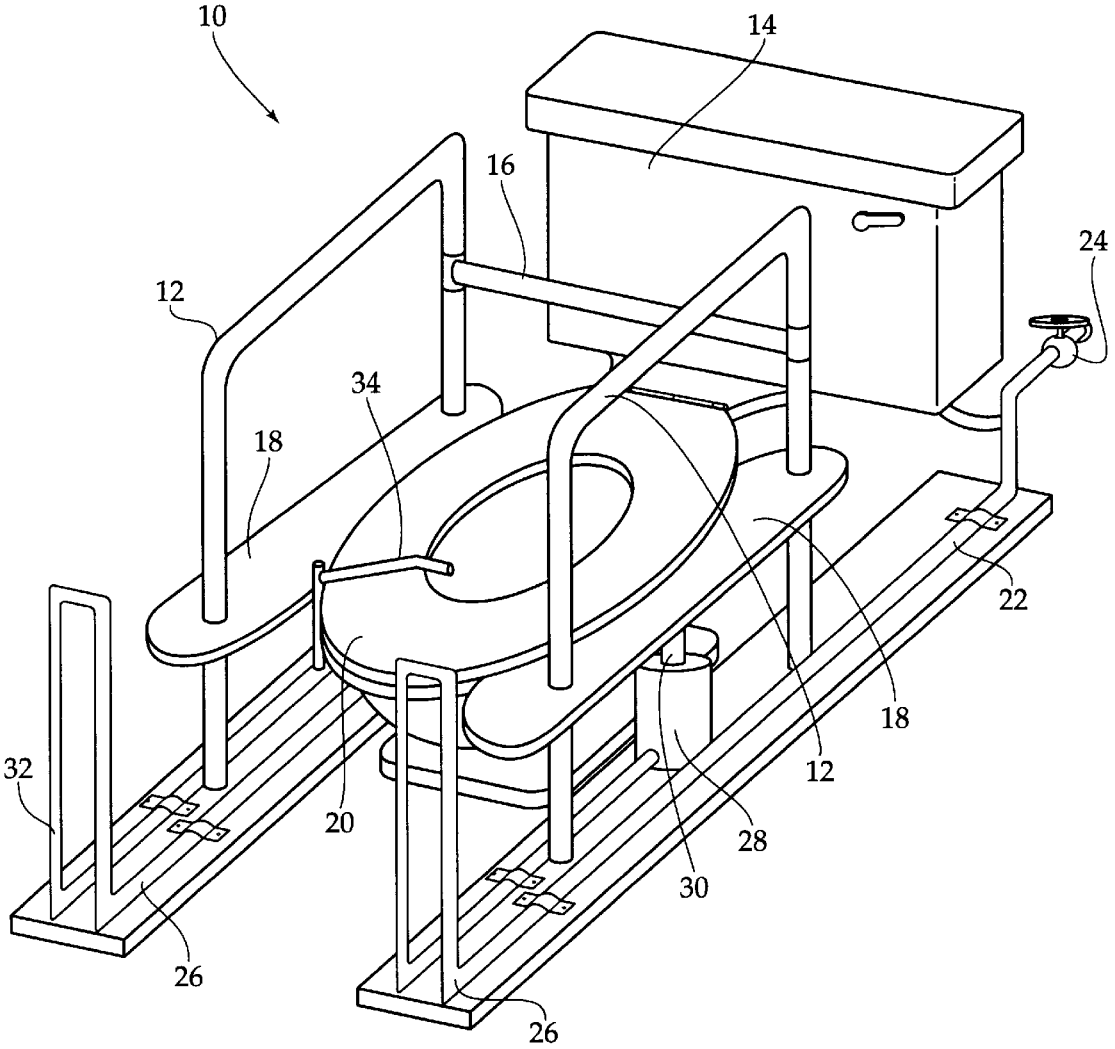
FIG. 1 is a perspective view of the preferred embodiment of the height adjustable toilet seat constructed in accordance with the principles of the present invention.

With reference now to the drawings, and in particular, to FIG. 1 thereof, the preferred embodiment of the new and improved height adjustable toilet seat embodying the principles and concepts of the present invention and generally designated by the reference number 10 will be described.

Specifically, it will be noted in the various Figures that the device relates to a height adjustable toilet seat for adjusting a height of a toilet seat using a standard water supply. In its broadest context, the device consists of a frame member, a water supply conduit, a pair of cylinders, a water outlet conduit, and a pair of control valves. Such components are individually configured and correlated with respect to each other so as to attain the desired objective.

The frame member is disposed on opposing sides of a toilet. The frame member includes a pair of inverted generally U-shaped members 12 disposed on opposing sides of the toilet 14. A cross bar 16 extends between rear vertical segments of the U-shaped members 12. The cross bar 16 acts as a support for the frame member and to balance the inverted U-shaped members 12. The inverted U-shaped members 12 perform various functions as discussed hereinafter, but these members 12 additionally serve the purpose of providing support for a person using the device 10. The U-shaped members 12 each have a sliding plate 18 slidably disposed thereon. The sliding plates 18 have a toilet seat 20 secured therebetween whereby the toilet seat 20 is positioned over a toilet bowl of the toilet 14.

The water supply conduit 22 is coupled with a standard water supply line 24. The water supply conduit 22 has a bifurcated outer portion 26 for positioning with respect to the inverted U-shaped members 12.

The pair of cylinders 28 are positioned underneath the sliding plates 18 of the inverted U-shaped members 12. The pair of cylinders 28 each have a water inlet in fluid communication with the bifurcated outer portion 26 of the water supply conduit 22. The pair of cylinders 28 each have a piston 30 extending upwardly therefrom and securing to an underside of the sliding plates 18. Each of the cylinders 28 have a water outlet. Thus, once water is received within the cylinders 28, the pressure will cause the pistons 30 to move upwardly thereby causing the toilet seat 20 to raise.

The water outlet conduit 32 is comprised of a bifurcated portion coupling with the water outlets of the pair of cylinders 28. The water outlet conduit 32 has a free end 34 extending within the toilet bowl.

The pair of control valves are coupled with respect to the water supply conduit 22 and the water outlet conduit 32 for selectively supplying water to and removing water from the pair of cylinders 28 to facilitate raising and lowering of the toilet seat 20 with respect to the toilet 14. The control valves have been omitted from the drawings for clarity, but are of the type known in the art and will be positioned so as a person sitting on the toilet seat 20 will have easy access thereto. One of the control valves will allow water to enter into the cylinders 28 to facilitate the raising of the toilet seat. The other valve will remove the water from the cylinders 28 to facilitate the lowering of the toilet seat 20. The water from the cylinders 28 will drain into the toilet bowl via the free end 34 of the water outlet conduit 32.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A height adjustable toilet seat for adjusting a height of a toilet seat using a standard water supply comprising, in combination:

a frame member disposed on opposing sides of a toilet, the frame member having sliding plates slidably disposed thereon, the sliding plates having a toilet seat secured therebetween whereby the toilet seat is positioned over a toilet bowl of the toilet;

a water supply conduit coupled with a standard water supply line, the water supply conduit having a bifurcated outer portion for positioning with respect to the frame member;

a pair of cylinders positioned underneath the sliding plates of the frame member, the pair of cylinders each having a water inlet in fluid communication with the bifurcated outer portion of the water supply conduit, the pair of cylinders each having a piston extending upwardly therefrom and securing to an underside of the sliding plates, each of the cylinders having a water outlet;

a water outlet conduit comprised of a bifurcated portion coupling with the water outlets of the pair of cylinders, the water outlet conduit having a free end extending within the toilet bowl.

2. The height adjustable toilet seat as set forth in claim 1 wherein frame member includes a pair of inverted generally U-shaped members disposed on opposing sides of the toilet, a cross bar extending between rear vertical segments of the U-shaped members, the U-shaped members each having the sliding plates slidably disposed thereon.

3. The height adjustable toilet seat as set forth in claim 1 and further including a pair of control valves coupled with respect to the water supply conduit and the water outlet conduit for selectively supplying water to and removing water from the pair of cylinders to facilitate raising and lowering of the toilet seat with respect to the toilet.

4. A height adjustable toilet seat for adjusting a height of a toilet seat using a standard water supply comprising, in combination:

a frame member disposed on opposing sides of a toilet, the frame member including a pair of inverted generally U-shaped members disposed on opposing sides of the toilet, a cross bar extending between rear vertical segments of the U-shaped members, the U-shaped members each having a sliding plate slidably disposed thereon, the sliding plates having a toilet seat secured therebetween whereby the toilet seat is positioned over a toilet bowl of the toilet;

a water supply conduit coupled with a standard water supply line, the water supply conduit having a bifurcated outer portion for positioning with respect to the inverted U-shaped members;

a pair of cylinders positioned underneath the sliding plates of the inverted U-shaped members, the pair of cylinders each having a water inlet in fluid communication with the bifurcated outer portion of the water supply conduit, the pair of cylinders each having a piston extending upwardly therefrom and securing to an underside of the sliding plates, each of the cylinders having a water outlet;

a water outlet conduit comprised of a bifurcated portion coupling with the water outlets of the pair of cylinders, the water outlet conduit having a free end extending within the toilet bowl;

a pair of control valves coupled with respect to the water supply conduit and the water outlet conduit for selectively supplying water to and removing water from the pair of cylinders to facilitate raising and lowering of the toilet seat with respect to the toilet.

* * * * *